United States Patent [19]

Nicoloso

[11] Patent Number: 4,774,387

[45] Date of Patent: Sep. 27, 1988

[54] DIELECTRIC GAS HIGH-TENSION CIRCUIT-BREAKER HAVING A CLOSURE RESISTANCE

[75] Inventor: Dante Nicoloso, Jonage, France

[73] Assignee: Alsthom, Paris, France

[21] Appl. No.: 126,392

[22] Filed: Nov. 13, 1987

[30] Foreign Application Priority Data

Dec. 1, 1986 [FR] France ..... 86 16746

[51] Int. Cl.[4] ..... H01H 33/16

[52] U.S. Cl. ..... 200/144 AP; 200/148 R; 200/148 B

[58] Field of Search ..... 200/144 AP, 148 R, 148 B

[56] References Cited

U.S. PATENT DOCUMENTS 4,421,962 12/1983 Thuries et al. ..... 200/144 AP 4,500,762 2/1985 Yoshizumi ..... 200/144 AP

*Primary Examiner*—Robert S. Macon

*Attorney, Agent, or Firm*—Sughrue, Mion, Zinn, Macpeak & Seas

[57] ABSTRACT

A high-tension circuit-breaker having a circuit-breaking chamber filled with a dielectric gas under pressure and including a resistance disposed coaxially with the circuit-breaking chamber and an insertion device for inserting said resistance into the circuit protected by the circuit-breaker while the circuit-breaker is closing, said insertion device being placed inside the circuit-breaking chamber and including a resistance-inserting contact in electrical contact with one end of the resistance, the circuit-breaker including the improvement of a base (22) at one of its ends, said base being closed by a first cover (51), with said resistance (4) being disposed in a cylindrical housing (60) which is fixed to said base, said housing being closed by a second cover (70), the first cover being provided with a central opening constituting a seat for a first valve plate (83) which is biased by a first spring (85), the second cover being provided with a central opening constituting a seat for a second valve plate (91) which is biased by a second spring (93), the valve plates being associated with means for keeping them open against the bias of the springs when the housing (60) is in the position on the base, and for closing them when the housing is at a distance from the base, said means providing the electrical connection between said resistance (4) and said resistance-inserting contact (3A), the housing co-operating in sealed manner with the first cover while being disassembled therefrom in such a manner as to prevent air from being admitted into the space lying between the covers until the valves are closed.

4 Claims, 4 Drawing Sheets

DIELECTRIC GAS HIGH-TENSION CIRCUIT-BREAKER HAVING A CLOSURE RESISTANCE

The present invention relates to a compressed dielectric gas high-tension circuit-breaker of the type including a resistance which can be inserted while the circuit-breaker is being closed.

BACKGROUND OF THE INVENTION

Such a circuit-breaker is described in French Pat. No. 79 05478 filed Mar. 2, 1979 and in French Pat. No. 80 16222 filed July 23, 1980. Reference may also be made to U.S. Pat. No. 4,421,962 which claims priority from the latter French patent.

The circuit-breakers described in these patents have the following feature: the device for inserting the closure resistance is located in the circuit-breaking chamber while the closure resistance itself is disposed in a housing which is coaxial with the circuit-breaking chamber and which extends axially therefrom. The inside of the housing is in communication with the circuit-breaking chamber and is therefore filled with dielectric gas at the same pressure as in the chamber.

This disposition has numerous advantages which are described in said prior patents, and in particular it reduces the bulk and the cost of the circuit-breakers.

Nevertheless there is a drawback: a circuit-breaker made as described in the patents is very long because of the housing containing the closure resistance. As a result such a circuit-breaker is difficult to transport from the factory to the site where it is to be installed, since it must be transported as a single unit. There is no question of separating the circuit-breaking chamber and the housing for transport purposes since it would then be necessary to fill them with dielectric gas on site where safety conditions for proper filling are difficult to obtain.

Further, users desire to be able to replace one or more components of the resistance on site without putting the inside of the circuit-breaking chamber into communication with the atmosphere since that would require subsequent refilling with dielectric gas, which is difficult to do, on site.

An aim of the invention is to provide a circuit-breaker having a closure resistance placed in a housing which extends the circuit-breaking chamber and which is in communication therewith, but which is made in such a manner as to enable the housing to be separated from the chamber and reassembled therewith without loss of gas either from the chamber or from the housing.

This would make it possible to fill the circuit-breaker with dielectric gas in a factory having all the necessary facilities. It could then be transported to its installation site as two separate units, thereby facilitating transport and handling. Finally it could be assembled on site without there being any need to perform dielectric gas filling operations.

If the closure resistance needs to be totally or partially replaced, only the housing would need putting into communication with the atmosphere, with the chamber remaining filled with dielectric gas.

SUMMARY OF THE INVENTION

The present invention provides a high-tension circuit-breaker having a circuit-breaking chamber filled with a dielectric gas under pressure and including a resistance disposed coaxially with the circuit-breaking chamber and an insertion device for inserting said resistance into the circuit protected by the circuit-breaker while the circuit-breaker is closing, said insertion device being placed inside the circuit-breaking chamber and including a resistance-inserting contact in electrical contact with one end of the resistance, the circuit-breaker including the improvement of a base at one of its ends, said base being closed by a first cover, with said resistance being disposed in a cylindrical housing which is fixed to said base, said housing being closed by a second cover, the first cover being provided with a central opening constituting a seat for a first valve plate which is biased by a first spring, the second cover being provided with a central opening constituting a seat for a second valve plate which is biased by a second spring, the valve plates being associated with means for keeping them open against the bias of the springs when the housing is in position on the base, and for closing them when the housing is at a distance from the base, said means providing the electrical connection between said resistance and said resistance-inserting contact, the housing co-operating in sealed manner with the first cover while being disassembled therefrom in such a manner as to prevent air from being admitted into the space lying between the covers until the valves are closed.

BRIEF DESCRIPTION OF THE DRAWINGS

Embodiments of the invention are described by way of example with reference to the accompanying drawings, in which.

DESCRIPTION OF PREFERRED EMBODIMENTS

Figure 1:
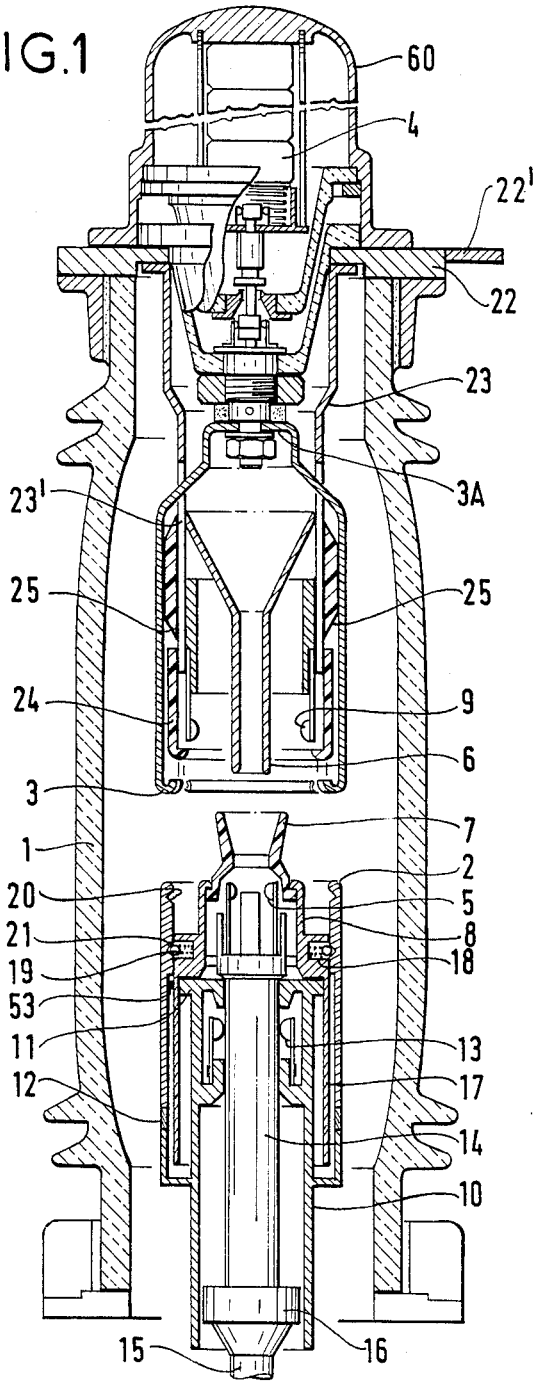
FIG. 1 is an axial section through a first circuit-breaker including the improvements of the invention.

FIG. 1 is an axial section through the circuit-breaker described in above-mentioned French Pat. No. 79 95478 having the improvements of the invention applied thereto.

It comprises an insulating envelope 1 filled with dielectric gas such as sulfur hexafluoride ($SF_6$) at a pressure of a few bars.

FIG. 1 shows the following sets of contacts: a tubular moving main contact 8 and a fixed main contact constituted by a set of contact fingers 9 disposed at the ends of supports 23; a tubular moving resistance-inserting contact 2· and a tubular fixed resistance-inserting contact 3 for inserting a closure resistance 4; and moving and fixed arcing contacts 5 and 6 respectively with the moving arcing contact 5 having a blast nozzle 7. The main contacts 8 and 9 pass electricity when the circuit-breaker is in the closed position. At the moving end, electricity arrives via a fixed tube 10 which is integral with a fixed piston 11, and then via a fixed abutment 12, the moving tubular resistance-inserting contact 2, and fixed fingers 13. The fingers pass electrical current between the tube 10 and a moving rod 14 driven by a drive shaft 15 and guided by means of a shoulder 16 to slide inside the tube 10 which serves as a support for the moving components. The rod 14 supports a moving cylinder 17 having bores 28 formed in the bottom thereof, each containing a ball 19 urged radially outwardly by a spring. The balls 19 co-operate with two notches 20 and 21 provided on the inside of the moving tubular resistance-inserting contact 2 which is disposed concentrically around the moving cylinder 17 and which is capable of sliding therealong between the notches. The moving cylinder 17 has a sliding contact 53 to ensure electrical conductivity with the moving tubular resistance-inserting contact 2. The moving cylinder 17 surrounding the fixed piston 11 serves to compress the gas. At the fixed contact end, electrical current comes from a connector tab 22' fixed on a base 22, and passes via the support 23 whose opposite end constitutes arms 23' with large gaps therebetween, followed by the fingers 9 and an abutment 24.

The fixed tubular resistance-inserting contact 3 is insulated from the support 23 by insulating parts 25.

Figure 2:
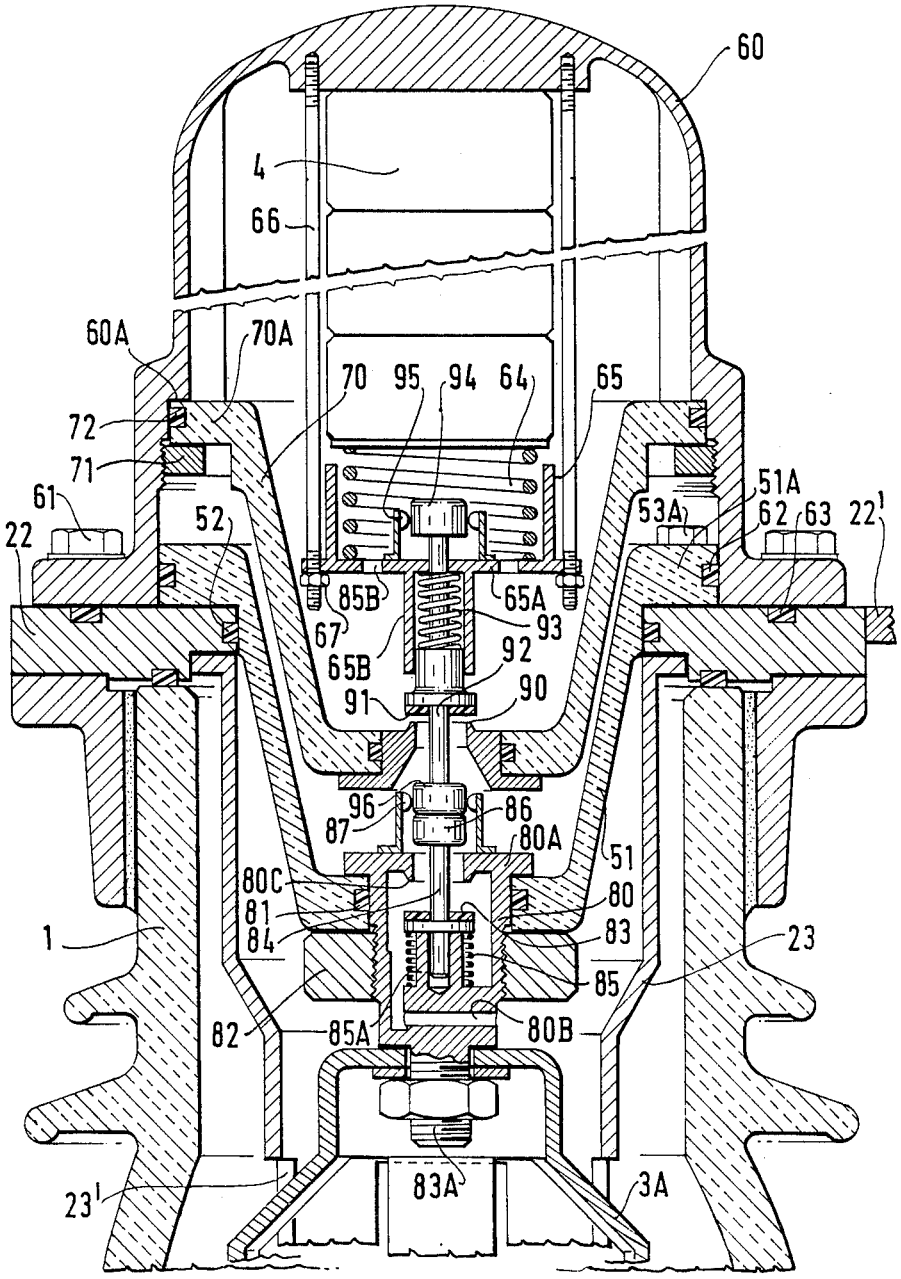
FIG. 2 is a fragmentary axial section through the circuit-breaking chamber and the resistance-containing housing of the FIG. 1 circuit-breaker shown in the assembled configuration.

Reference is now made to FIG. 2.

In accordance with the invention, the circuit-breaking chamber is closed by a cover 51 having an annular flange 51A resting against the base 22. A sealing ring 52 provides sealing between the base 22 and the cover 51. The cover is fixed on the base by means of bolts such as 53A.

The closure resistance 4 is disposed in a metal housing 60 which is itself fixed on the base 22 by means of bolts 61. Sealing rings 62 and 63 respectively provide sealing between the housing and the flange 51A of the cover 51 and between the housing and the base 22.

The resistance 4 comprises a stack of components which are pressed together by a spring 64 disposed in a metal cylinder 65. The bottom **65*a* of the cylinder is fixed by draw-bars 66 each having one end screwed into the housing and having its other end fitted with a notch 67** which is tightened to ensure that the spring is suitably compressed.

The housing is closed by a cover 70 having an annular flange 70A bearing against an inside step 60A in the housing 60. An externally threaded nut 71 is screwed into a tapped portion of the housing and clamps the flange 70A against the step 60A. A sealing ring 72 provides sealing between the cover 70 and the housing 60.

The cover 51 has an opening in its center with a metal cylinder 80 inserted therein, said cylinder bearing in sealed manner via a sealing ring 81 against the inside edge of the opening. On the outside of the cover 51, the cylinder has a flange 80A which bears against the cover. A nut 82 co-operates with a threaded portion of the cylinder and serves to fix it to the cover 51.

Further, the cylinder 80 is extended by a threaded rod 83A enabling it to be screwed to one end 3A of the tube 3 for putting the resistance into circuit. The cylinder 80 is drilled at 80B in order to provide communication between the inside of the cylinder and the inside of the circuit-breaking chamber.

Figure 3:
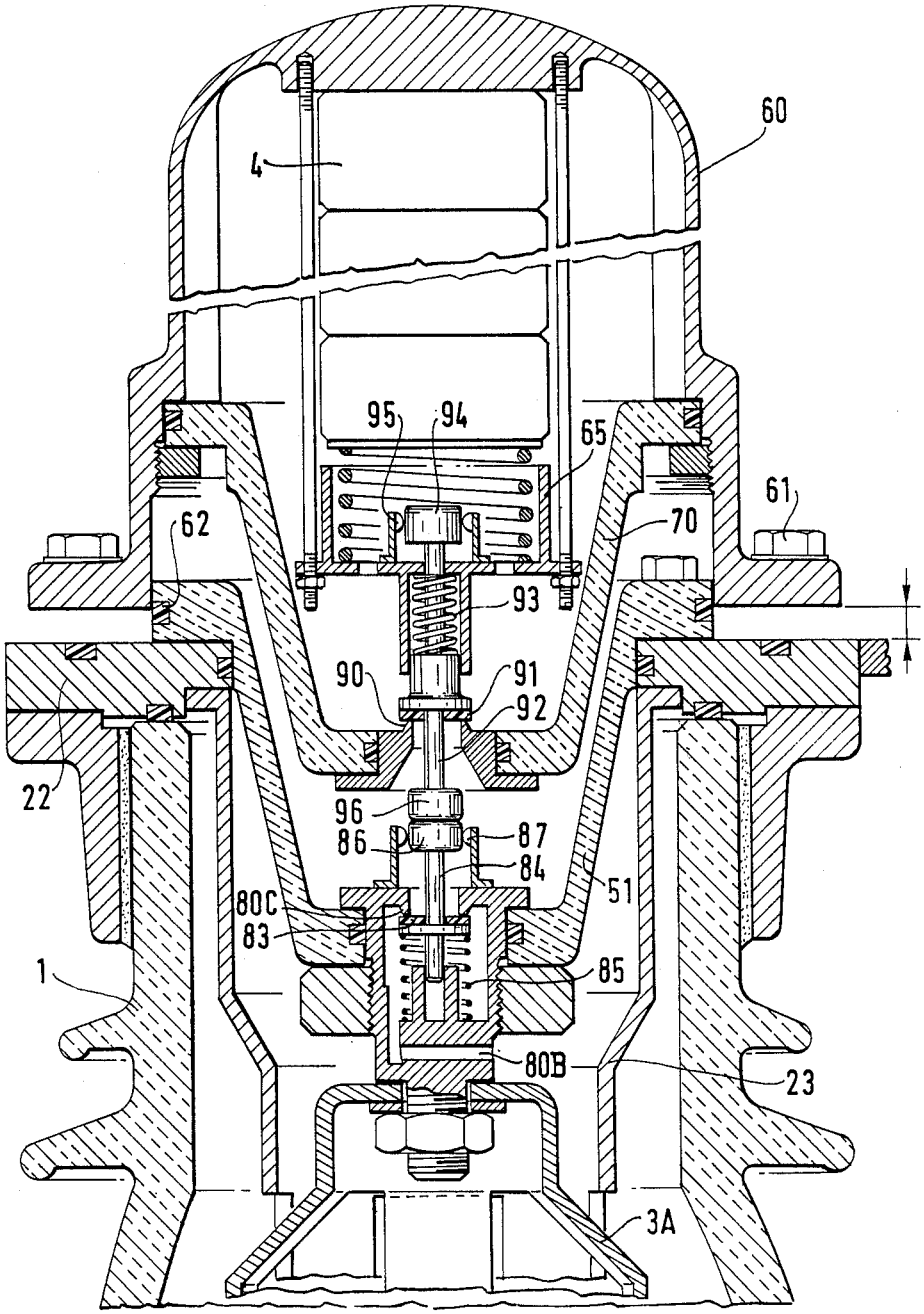
FIG. 3 is a fragmentary axial section through the chamber and the housing of the FIG. 2 circuit-breaker shown in the disassembled configuration.

The inside of the flange 80A has a rim 80C serving as a seat for a valve plate 83 carried by a rod 84 which slides in a cylinder and which has a spring 85 guided by a core 85A pressing thereagainst. The rod extends beyond the cylinder and is terminated by a contact tab 86. The flange 80A has contact fingers 87 which, when the spring 85 is extended, co-operate with the contact tab 86 (FIG. 3). In this case, the valve plate 83 bears against its seat and communication between the crcuit-breaking chamber and the outside of the cylinder 80 is prevented.

The cover 70 of the housing 60 has an opening provided with a rim 90 serving as a seat for a valve plate 91 carried by a rod 92. The rod 92 is urged by a spring 93 pressing against the bottom 65A. The spring is held by a tubular portion 65B integrally cast or formed with the cylinder 65 and its bottom 65A. The rod extends inside the cylinder 65 and is terminated by a contact tab 94 co-operating with contact fingers carried by the bottom 65A.

The end of the rod 92 extending away from the valve plate is terminated by a contact tab 96 suitable for co-operating electrically with the fingers 87.

The spring 93 is stronger than the spring 85 such that when the housing is fixed on its base (as shown in FIG. 2 which corresponds to the circuit-breaker being in operation), the tab 96 pushes the tab 86 so as to bring the valve plate 83 into abutment away from its seat and against the core 85A, thereby leaving a communication path between the inside and the outside of the cylinder 80. Further, the sizes of the various items are chosen so that when the valve plate 83 is in abutment against the core 85A, the valve 91 is open.

It can thus be seen that when the circuit-breaker is assembled, gas can flow freely from the circuit-breaking chamber to the resistance 4 by passing through the duct 80B, the inside of the cylinder 80, between the finger 87, and via the open valve 90-91.

Orifices 85B in the bottom 85A facilitate gas flow around the resistance 4.

For a full explanation of how the resistance 40 is put into circuit when closing the circuit-breaker, reference may be made to the above-mentioned patents.

It suffices in the present specification to recall that moving the moving rod 14 upwardly in the figure causes the moving main contact 8 to move and, by virtue of the balls 19, causes the moving tubular resistance-inserting contact 2 to move as well.

When the moving tubular resistance-inserting contact 2 comes into contact with its fixed counterpart 3, the resistance 4 is inserted in the circuit-breaker circuit.

Electrical current than passes via the connection 22', the base 22, the housing 60, the resistance 4, the spring 64, the bottom 65A, the fingers 95, the tabs 94, the rod 92, the tab 96, the fingers 87, the cylinder 80, the end 3A of the tube 3, the tube 3, the insertion contact 2, the sliding contact 53, the moving cylinder 17, the rod 14, the fingers 13 and the tube 10.

When the arcing contacts 5 and 6 come into contact with each other, the resistance 4 is short-circuited and electrical current then flows via the connection 22', the base 22, the support 23, the fingers 9, the tube 6, the fingers 5, the rod 14, the fingers 13, and the tube 10.

If it is desired to disassemble the housing and the circuit-breaking chamber, this can be done in accordance with the invention without losing gas.

After removing the bolts 61, the housing 60 is raised to move it way from the base 22. This causes the rod 92 to move with the spring 85 thrusting the valve plate 83 against its seat, thereby closing the circuit-breaking chamber. Continuing to move the housing upwardly then causes the valve 91 to close against its seat, thus closing the housing. It may be observed that the strokes of the valves and the thickness of the rim 51A of the cover 51 are chosen so that the valves close before the sealing ring 62 has moved out of contact with the housing 60, thereby preventing any inlet of outside air.

The circuit-breaker is reassembled by replacing the housing on the base: the valves open in the opposite order. The quantity of air admitted during reassembly is very small since the air concerned is that which exists between the two covers 51 and 70.

The circuit-breaker can thus be transported from the factory where it is filled with dielectric gas to the site at which it is to be installed as two separate units. These units are reassembled easily without losing dielectric gas, without any need to add dielectric gas, and without admitting a significant quantity of air.

Action can be taken on the resistance without endangering sealing of the circuit-breaking chamber.

The covers 51 and 70 are advantageously frusto-conical in shape so that one is received within the other. In this way, the total axial length of the circuit-breaker is reduced as is the volume between the two covers when the circuit-breaker is assembled and consequently the volume of air which is admitted into the circuit-breaker during assembly.

The invention is equally applicable to the circuit-breaker described in French Pat. No. 80 16222. This patent describes a circuit-breaker in which the mechanism for putting the closure resistance into circuit includes semi-mobile equipment.

Figure 4:
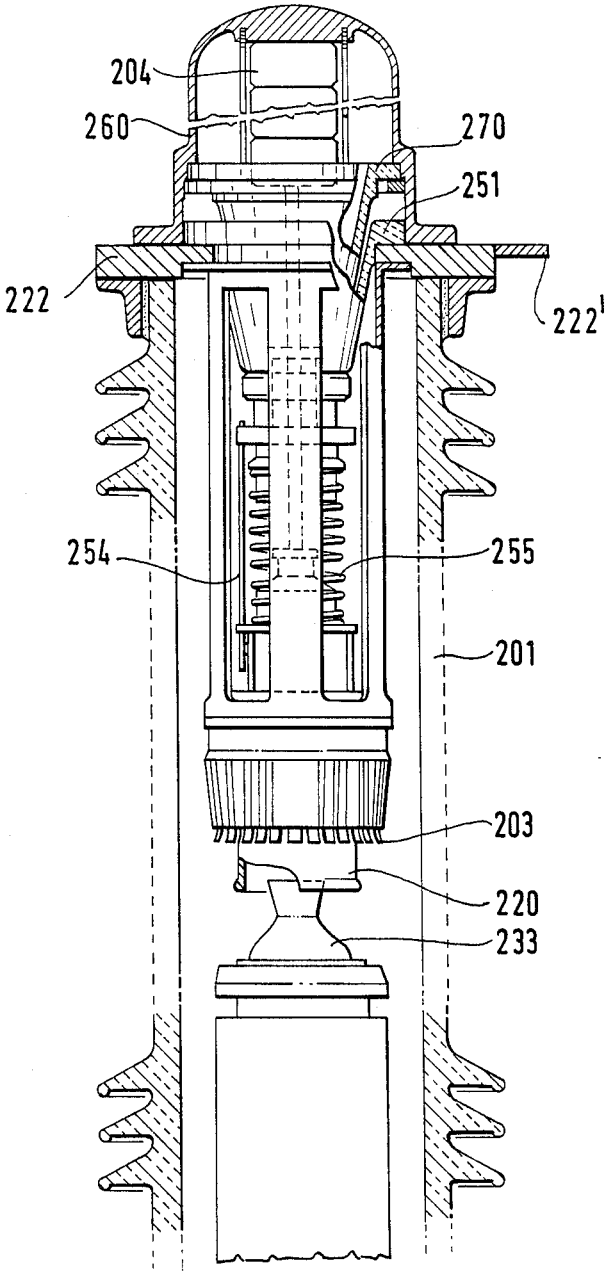
FIG. 4 is a fragmentary elevation view, partially in section, showing a second circuit-breaker including the improvements in accordance with the invention.

FIG. 4 shows a portion of the circuit-breaking chamber delimited by an insulating envelope 201 and closed by a cover 251, and also shows a housing 260 closed by a cover 270.

As above, the housing is fixed to a base 222 provided with a current connection 222'.

The closure resistance 204 is connected via a mechanism entirely identical to that shown in FIGS. 2 and 3 to an insertion assembly including a rod 254, a semi-mobile contact 220, and a return spring 255.

FIG. 4 also shows the main fixed contact fingers 203 and the nozzle 233 belonging to the moving equipment.

Reference can be made to the above-mentioned patent to describe the operaton of the circuit-breaker, and to the above description made with reference to FIGS. 2 and 3 for how the present invention is implemented in this case.

What is claimed is:

1. A high-tension circuit-breaker having a circuit-breaking chamber filled with a dielectric gas under pressure and including a resistance disposed coaxiallly with the circuit-breaking chamber and an insertion device for inserting said resistance into the circuit protected by the circuit-breaker while the circuit-breaker is closing, said insertion device being placed inside the circuit-breaking chamber and including a resistance-inserting contact in electrical contact with one end of the resistance, the circuit-breaker including the improvement of a base at one of its ends, said base being closed by a first cover, with said resistance being disposed in a cylindrical housing which is fixed to said base, said housing being closed by a second cover, the first cover being provided with a central opening constituting a seat for a first valve plate which is biased by a first spring, the second cover being provided with a central opening constituting a seat for a second valve plate which is biased by a second spring, the valve plates being associated with means for keeping them open aganst the bias of the springs when the housing is in position on the base, and for closing them when the housing is at a distance from the base, said means providing the electrical connection between said resistance and said resistance-inserting contact, the housing co-operating in sealed manner with the first cover while being disassembled therefrom in such a manner as to prevent air from being admitted into the space lying between the covers until the valves are closed.

2. A circuit-breaker according to claim 1, wherein said means comprise:

a first axial rod carrying the first valve plate and sliding in a bore through a core serving as an abutment to said first valve plate, said rod having a contact tab at its end furthest from the abutment for the purpose of co-operating with first contact fingers which are electrically connected to said insertion contact; and a second rod in alignment with the first rod and carrying the second valve plate, said second rod sliding in a cylinder containing said second spring, said second rod being provided at one end with a first contact tab for coming into contact with the contact tab of the first rod, and being provided at its opposite end with a second contact tab for coming into contact with contact fingers which are electrically connected to the resistance, the lengths of the rods being chosen so as to ensure that the valves open when the housing is assembled to the base.

3. A circuit-breaker according to claim 1, wherein the covers are frusto-conical in shape and are suitable for being partially received one within the other when the housing is assembled on the base, the first cover having a flange in contact with the base and with the housing.

4. A circuit-breaker according to claim 2, wherein the covers are frusto-conical in shape and are suitable for being partially received one within the other when the housing is assembled on the base, the first cover having a flange in contact with the base and with the housing.

* * * * *